US006880870B2

(12) United States Patent
Costigan

(10) Patent No.: US 6,880,870 B2
(45) Date of Patent: Apr. 19, 2005

(54) OUTSIDE VEHICLE DOOR HANDLE

(75) Inventor: Terrence P. Costigan, Fenton, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/644,343

(22) Filed: Aug. 20, 2003

(65) Prior Publication Data

US 2005/0040657 A1 Feb. 24, 2005

(51) Int. Cl.[7] ..... E05B 3/00
(52) U.S. Cl. ..... 292/336.3; 292/DIG. 53
(58) Field of Search ..... 292/336.3, 347, 292/348, DIG. 53; 16/412

(56) References Cited

U.S. PATENT DOCUMENTS 4,580,821 A 4/1986 Genord, Jr. et al. ..... 292/336.3
5,685,581 A * 11/1997 Kritzler et al. ..... 292/336.3
5,725,262 A * 3/1998 Kritzler ..... 292/336.3
5,791,703 A * 8/1998 Kritzler et al. ..... 292/336.3
6,363,577 B1 * 4/2002 Spitzley ..... 292/336.3
6,447,030 B1 * 9/2002 Meinke ..... 292/347
6,554,331 B1 4/2003 Ciborowski et al. ..... 292/347
6,594,861 B1 * 7/2003 Dimig et al. ..... 16/412

* cited by examiner

*Primary Examiner*—Gary Estremsky
(74) *Attorney, Agent, or Firm*—Laura C. Hargitt

(57) ABSTRACT

A handle assembly includes a pull handle that defines a pivot socket. A pivot bracket is rigidly mountable to a vehicle door outer panel and includes a pivot at least partially positioned within the pivot socket such that the pull handle is pivotable between a first position and a second position. The pivot is outside a vehicle door cavity, thereby eliminating the chassis preassembled inside the door cavity and eliminating goose-neck pivot attachments found in prior art pull-bar type handle assemblies.

2 Claims, 3 Drawing Sheets

OUTSIDE VEHICLE DOOR HANDLE

TECHNICAL FIELD

This invention relates to a pull-bar type outside vehicle door handle defining a pivot socket in the external portion of the handle.

BACKGROUND OF THE INVENTION

Prior art vehicle door handles include pull-bar type handle assemblies that include a chassis preassembled inside a door cavity. The chassis adds weight to a vehicle and its preassembly inside the door cavity may be cumbersome and time consuming. The prior art also includes pull-bar type outside handle assemblies that do not include a chassis preassembled inside the door cavity. However, these prior art handle assemblies include a gooseneck hinge connecting the pull handle to a pivot inside the door cavity. The gooseneck hinge prevents the outside handle latch rod from being subassembled to the handle prior to attachment to the door, and may cause packaging, loading, and assembly complications with key cylinders.

SUMMARY OF THE INVENTION

An outside handle assembly for a vehicle door is provided. The handle assembly includes a pull handle defining a pivot socket, and a pivot bracket rigidly mountable with respect to the door outer panel. A pivot portion of the pivot bracket is located within the pivot socket and thereby functions as a pivot about which the pull handle is pivotable between a first position and a second position.

The door handle assembly improves upon the prior art by moving the pivot from inside the door cavity to outside the door cavity and inside the handle, thereby eliminating the chassis preassembled inside the door cavity and gooseneck hinges. The handle assembly eliminates structural deformation of the outer panel that may occur with gooseneck hinges and allows the latch rod to be subassembled to the handle assembly prior to installation in the door. The pivot bracket is designed to snap into and be retained inside the handle cavity during shipping.

The above features and advantages, and other features and advantages, of the present invention are readily apparent from the following detailed description of the best mode for carrying out the invention when taken in connection with the accompanying drawings.

DESCRIPTION OF THE PREFERRED EMBODIMENTS

Figure 1:
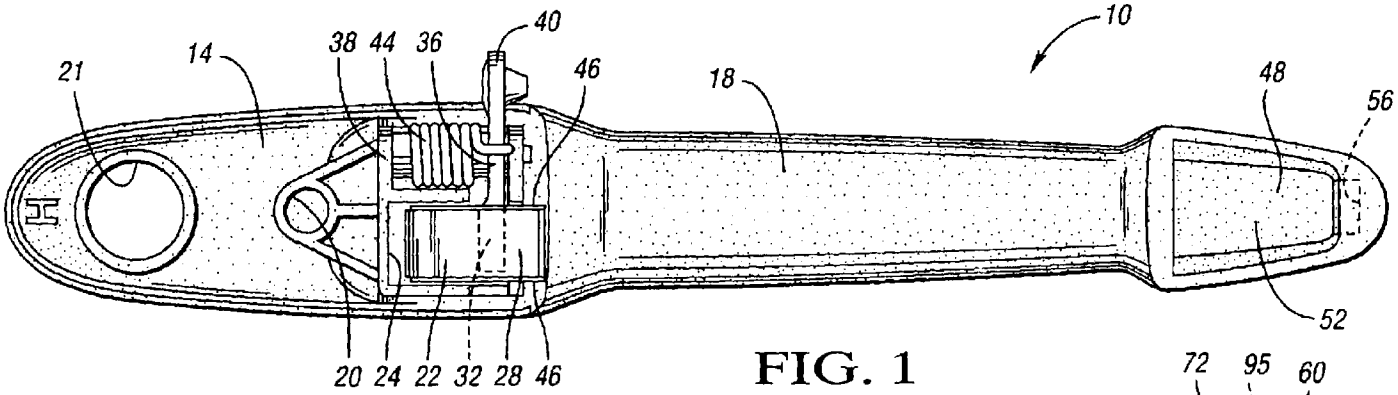
FIG. 1 is a schematic side view of a vehicle outside door handle assembly.

Referring to FIG. 1, an outside handle assembly 10 for a vehicle door includes a first member, or bezel 14, and a pull handle 18. The bezel 14 is rigidly mountable to a door outer panel (not shown) by driving a threaded fastener (not shown) into threaded hole 20. Those skilled in the art will recognize that it may be preferable to employ more threaded holes if more than one threaded fastener is necessary to satisfactorily mount the bezel to an outer panel. The bezel 14 defines aperture 21 for retaining a key cylinder (not shown).

The pull handle 18 is operatively connectable to a door latch (not shown) through a series of linkages and a rod to selectively disengage the latch from a striker, thereby enabling a door to open. A projection 22 on the pull handle 18 extends through an opening 24 in the bezel 14. The projection 22 is characterized by a hook portion 28. The hook portion 28 is in contact with a first arm 32 of a bell crank 36. The bell crank 36 is pivotally mounted to the bezel 14 on a bracket 38 integrally formed in the bezel. A second arm 40 of the bell crank is engageable with a latch rod (not shown). The latch rod is operatively connected to the latch such that downward movement of the latch rod causes the latch to disengage the striker. When a user pulls on the pull handle 18, the hook portion 28 exerts a force on the first arm 32 causing the bell crank 36 to pivot and exert a downward force on the latch rod via the second arm 40. A coil spring 44 biases the bell crank such that the latch rod remains in a first position, in which the latch remains engaged, until sufficient force is applied to the pull handle 18 to overcome the force exerted by the spring 44. A low-friction material 46 is employed on the projection 22 to facilitate relative movement between the projection 22 and the bezel 14.

The pull handle 18 defines a cavity 48 spaced a distance apart from the projection 22. The cavity 48 includes a first chamber 52 and a second chamber 56. The second chamber is sometimes referred to hereinafter as a "pivot socket."

Figure 2:
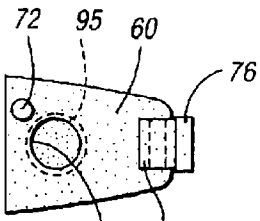
FIG. 2 is a schematic side view of a pivot bracket of the handle assembly of FIG. 1.

Referring to FIG. 2, the handle assembly also includes a second member sometimes referred to hereinafter as a "pivot bracket" 60. Pivot bracket 60 is rigidly mountable to a vehicle door outer panel by a threaded fastener (not shown) engaging threaded hole 64. Pivot bracket 60 also includes a snap fit feature 68 for temporarily retaining pivot bracket 60 with respect to an outer panel while a threaded fastener is driven into threaded hole 64. Pivot bracket 60 also includes a locator pin 72 for positively locating pivot bracket 60 during assembly to an outer panel. Pivot bracket 60 is slightly smaller in size than the cavity 48 in the pull handle 18 of FIG. 1, and is adapted to be installed therein. A pivot portion 76 of pivot bracket 60 is configured to function as a pivot inside the pivot socket 56.

Figure 3:
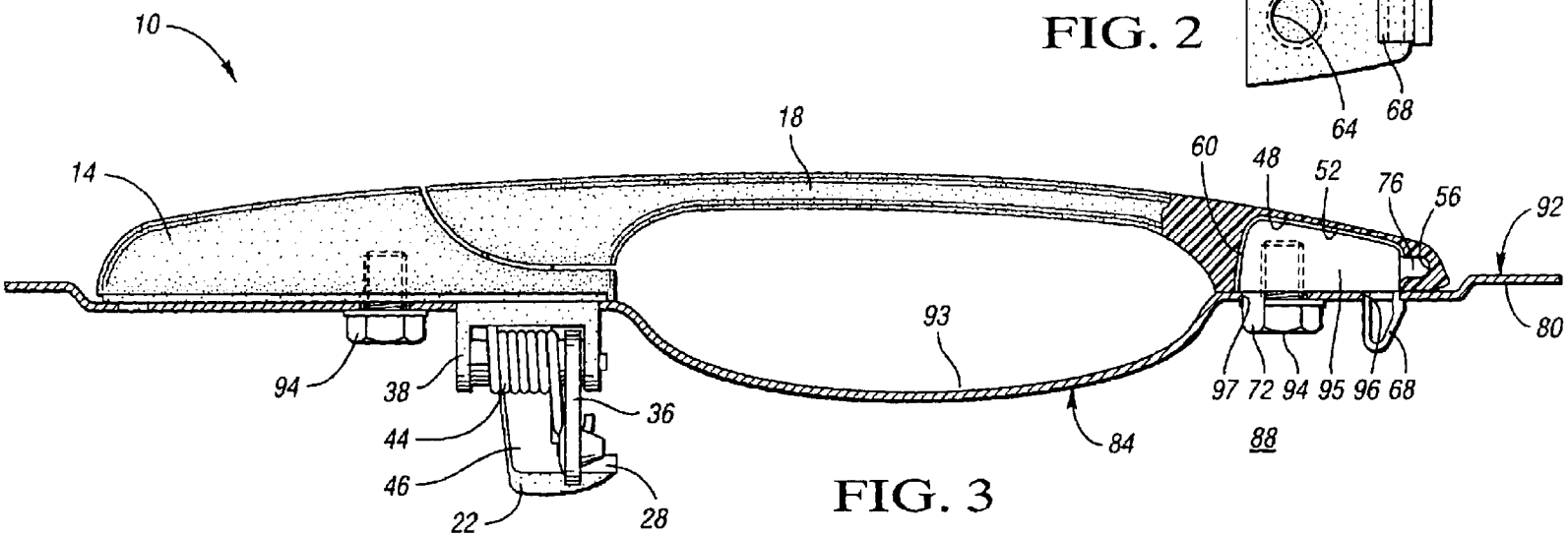
FIG. 3 is a schematic partial cutaway top view of the handle assembly of FIG. 1 mounted to a vehicle door outer panel in a closed position.

Referring to FIG. 3, wherein like reference numbers refer to like components from FIGS. 1 and 2, the handle assembly 10 is operatively connected to a vehicle door outer panel 80. The outer panel 80 includes an inner surface 84 that, in cooperation with an inner panel (not shown), partially defines a door cavity 88. The outer panel is characterized by outer surface 92 which partially defines the exterior surface of a door. The outer panel 80 defines a concavity 93 open in the direction of the pull handle 18 to accommodate a user's fingers when grasping the pull handle. The bezel 14 is rigidly mounted to the outer panel 80 with a threaded fastener 94. A portion of the bezel 14 is positioned outboard of the outer surface 92, and a portion of the bezel 14 is positioned inside the door cavity 88. More specifically, the bell crank 36, the spring 44 and the bracket 38 on which they are supported extend into the door cavity through a hole (not shown) in the outer panel. Projection 22 extends from the pull handle 18 into the door cavity 88.

The pivot bracket 60 is also rigidly mounted to the outer panel 80 with a threaded fastener 94. A portion of the snap fit feature 68 extends through an opening 96 in the outer panel 80 and into the door cavity 88 for retaining the pivot bracket while the threaded fastener 94 is driven from the door cavity into the threaded bole in the pivot bracket. The locator pin 72 extends through an aperture 97 in the outer panel 80 to locate and properly orient the pivot bracket 60. The remainder of the pivot bracket 60 is positioned outside the door cavity outboard of the outer panel, and is nested within the pull handle cavity 48 so as to be concealed from view from the exterior of the vehicle door. A portion 95 of the pivot bracket 60 projects outwardly from the outer surface 92, and is nested within the first chamber 52. The pivot portion 76 is located within the pivot socket 56.

The handle assembly 10 is shown in a closed position. The spring 44 biases the pull handle 18 in the closed position via the bell crank 36 contacting the hook: portion 28 of the projection 22.

Figure 4:
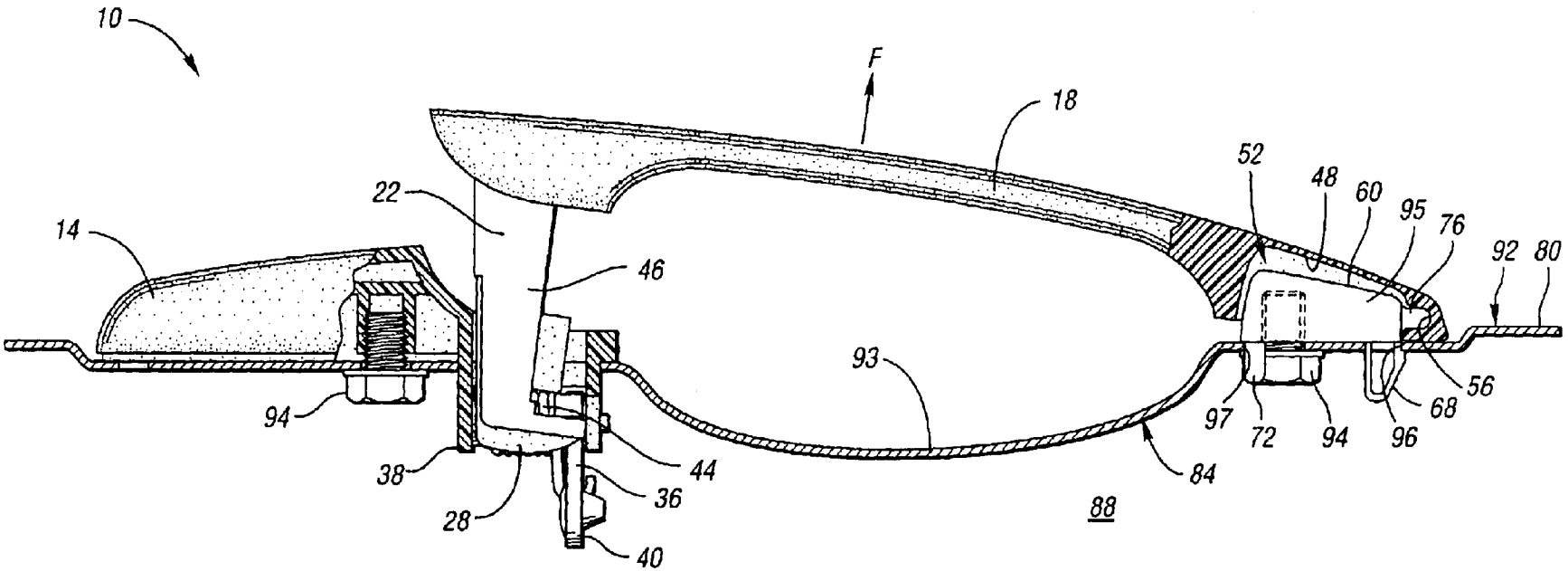
FIG. 4 is a schematic partial cutaway bottom view of the handle assembly of FIG. 3 in an open position.

Referring to FIG. 4, wherein like reference numbers refer to like components from FIGS. 1-3, the handle assembly 10 is shown in its open position. An outward force F exerted on the pull handle 18 is transmitted via the projection 22 and the hook portion 28 to the bell crank 36. The force is sufficient to overcome the force exerted by the spring 44 and causes rotation of the bell crank 36. The second arm 40 of the bell crank 36 is correspondingly moved which results in downward movement of the latch rod (not shown) to a second position and, correspondingly, the door latch disengaging the striker. During movement between the closed position and the open position, the pull handle 18 pivots about the pivot portion 76 of the pivot bracket 60. The cavity 48 is located outward of the outer surface 92, and therefore the pivot point is outside the door cavity 88. The first chamber 52 is open in the direction of the outer panel 80 to provide clearance for relative movement between the portion 95 of the pivot bracket in the first chamber 52 and the pull handle 18. The pivot socket 56 is closed in the direction of the outer panel 80 to provide a surface against which the pivot portion exerts a reaction force to retain the handle 18, thus resulting in the pivoting motion of the pull handle 18.

Figure 5:
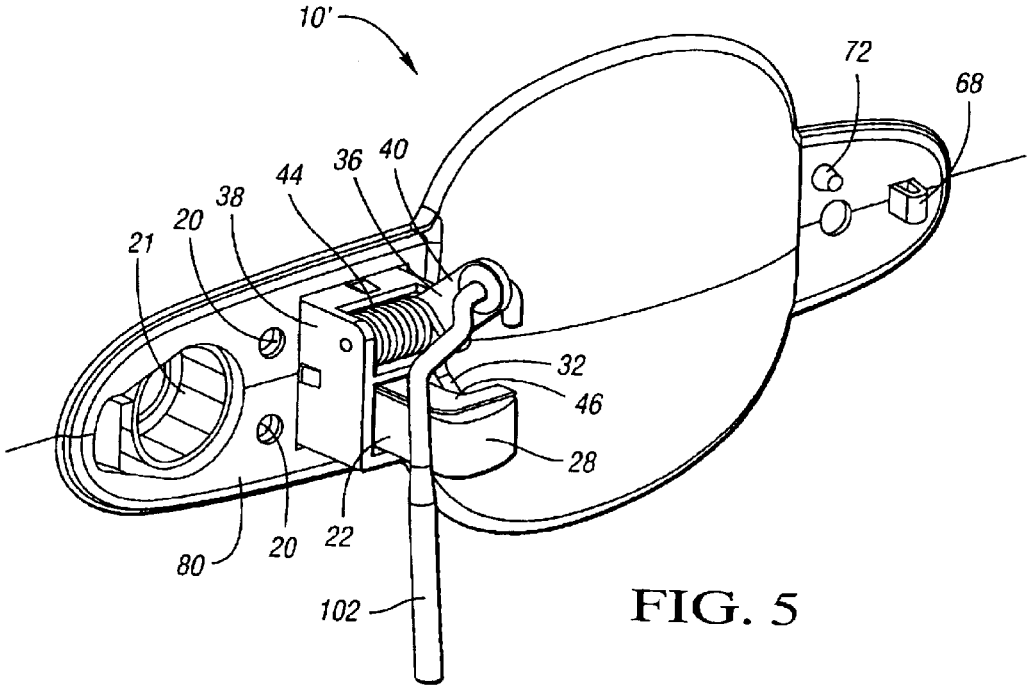
FIG. 5 is a schematic perspective view of another embodiment of the handle assembly mounted to a door outer panel.
Figure 6:
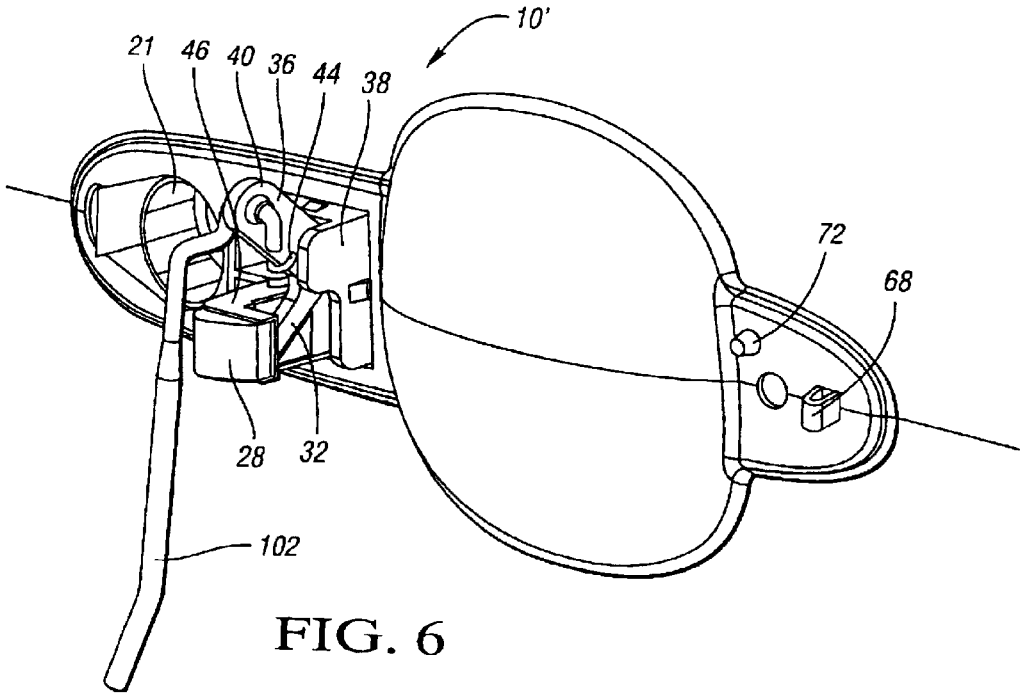
FIG. 6 is another schematic perspective view of the door handle assembly of FIG. 5.

Referring to FIGS. 5 and 6, an alternative embodiment of the handle assembly 10' is schematically depicted with the latch rod 102 operatively engaged with the second arm 40 of the bell crank 36. The bezel of handle assembly 10' includes two threaded holes 20.

The outside handle assemblies of FIGS. 1–6 simplify the door handle fabrication process compared to the prior art, and eliminate the pivot pins found in the prior art. The handle assemblies of FIGS. 1–6 enable the use of simplified injection molding tools for use in the fabrication of the handle assemblies.

While the best modes for carrying out the invention have been described in detail, those familiar with the art to which this invention relates will recognize various alternative designs and embodiments for practicing the invention within the scope of the appended claims.

What is claimed is:

1. A vehicle door comprising:

an outer panel characterized by an outer surface at least partially defining the exterior surface of the door and a inner surface at least partially defining a door cavity;

a pivot bracket having a pivot projecting therefrom, the pivot bracket being rigidly mounted with respect to the outer panel such that the pivot is positioned outboard of the outer surface;

a bezel spaced a distance apart from the pivot bracket and rigidly mounted with respect to the outer panel, the bezel defining an aperture;

a pull handle, the pull handle defining a pivot socket at a first end in which the pivot is at least partially located and having a projection at a second end opposite the first end the projection extending from the pull into the door cavity through the aperture in the bezel;

wherein the pull handle is pivotable about the pivot between a first position and a second position; and wherein the pull handle defines a cavity having a first chamber and a second chamber; wherein the first chamber is open in the direction of the outer panel; wherein the second chamber is the pivot socket and is closed is the direction of the outer panel; and wherein a portion of the pivot bracket is located within the first chamber.

2. The vehicle door of claim 1, wherein the pull handle conceals the pivot bracket from view from the exterior of the vehicle door when the pull handle is in the first position.

* * * * *